US005702241A

United States Patent [19]

Matsumoto et al.

[11] Patent Number: 5,702,241

[45] Date of Patent: Dec. 30, 1997

[54] SCROLL-TYPE FLUID DISPLACEMENT APPARATUS HAVING SEALING MEANS FOR CENTRAL PORTIONS OF THE WRAPS

[75] Inventors: Takayuki Matsumoto; Yasuomi Matsumoto; Hiroshi Fujita, all of Isesaki, Japan

[73] Assignee: Sanden Corporation, Gunma, Japan

[21] Appl. No.: 633,441

[22] Filed: Apr. 17, 1996

[30] Foreign Application Priority Data

Apr. 19, 1995 [JP] Japan ..... 7-119225

[51] Int. Cl.[6] ..... F01C 1/04; F01C 19/08

[52] U.S. Cl. ..... 418/55.4; 418/142

[58] Field of Search ..... 418/55.4, 142

[56] References Cited

U.S. PATENT DOCUMENTS

| | | | |
|---|---|---|---|
| 3,986,799 | 10/1976 | McCullough | 418/56 |
| 3,994,633 | 11/1976 | Shaffer | 418/5 |
| 3,994,635 | 11/1976 | McCullough | 418/57 |
| 3,994,636 | 11/1976 | McCullough et al. | 418/142 |
| 4,065,279 | 12/1977 | McCullough | 418/55.4 |
| 4,199,308 | 4/1980 | McCullough | 418/142 |
| 4,309,039 | 1/1982 | Irick | 277/204 |
| 4,345,886 | 8/1982 | Nakayama et al. | 418/100 |
| 4,395,205 | 7/1983 | McCullouch | 418/142 |
| 4,415,317 | 11/1983 | Butterworth | 418/142 |
| 4,416,597 | 11/1983 | Eber et al. | 418/142 |
| 4,453,899 | 6/1984 | Hiraga et al. | 418/142 |
| 4,462,771 | 7/1984 | Teegarden | 418/142 |
| 4,627,799 | 12/1986 | Terauchi | 418/142 |
| 4,655,697 | 4/1987 | Nakamura et al. | 418/142 |
| 4,701,115 | 10/1987 | Shimizu et al. | 418/142 |
| 4,730,375 | 3/1988 | Nakamura et al. | 418/142 |
| 4,869,658 | 9/1989 | Tsutsumi et al. | 418/142 |
| 4,969,810 | 11/1990 | Stolle et al. | 418/55.4 |

FOREIGN PATENT DOCUMENTS

| | | | |
|---|---|---|---|
| 0012614 | 6/1980 | European Pat. Off. . | |
| 0065261 | 11/1982 | European Pat. Off. . | |
| 0227249 | 7/1987 | European Pat. Off. . | |
| 1395747 | 3/1965 | France | 418/142 |
| 2319789 | of 0000 | Germany . | |
| 63-212787 | 9/1988 | Japan | 418/55.4 |
| 6235386 | 8/1994 | Japan | 418/55.4 |
| 6272680 | 9/1994 | Japan | 418/55.4 |
| 9506820 | 3/1995 | WIPO . | |

*Primary Examiner*—John J. Vrablik
*Attorney, Agent, or Firm*—Baker & Botts, L.L.P.

[57] ABSTRACT

A scroll-type fluid displacement apparatus includes a first and a second scroll, each having an end plate and a spiral wrap extending from one side of the end plate. The spiral wraps interfit at an angular and radial offset to make a plurality of line contacts which define a pair of fluid pockets. A driving mechanism is operatively connected to the first scroll to orbit the first scroll relative to the second scroll while preventing rotation of the second scroll, to thereby change the volume of the pair of fluid pockets. Sealing elements are disposed in the axial ends of the spiral wraps for sealing a central portion of fluid pockets defined by the spiral wraps. Thus, the axial sealing of fluid pocket formed between the orbiting and fixed scroll is more secure in all process from the suction to the discharge stage. Further, the volumetric efficiency of the compressor increases.

6 Claims, 4 Drawing Sheets

SCROLL-TYPE FLUID DISPLACEMENT APPARATUS HAVING SEALING MEANS FOR CENTRAL PORTIONS OF THE WRAPS

BACKGROUND OF THE INVENTION

1. Field of the Invention

The invention relates to a fluid displacement apparatus, and more particularly, to an axial sealing mechanism for a scroll-type fluid displacement apparatus.

2. Description of the Related Art

Scroll-type fluid displacement apparatus are well known. For example, U.S. Pat. No. 4,740,143 to Nakamura et al., the disclosure of which is incorporated herein by reference, describes apparatus including two scroll members each having a circular end plate and a spiroidal or involute spiral element. These scroll members are angularly and radially offset from each other, so that both spiral elements interfit to form a plurality of line contracts between their spiral curved surfaces and to thereby seal off and define at least one pair of fluid pockets. The relative orbital motion of the two scroll members shifts the line contacts long the spiral curved surfaces and, therefore, the fluid pockets change in volume. Because the volume of the fluid pockets may increase or decrease depending on the direction of the orbital motion, such scroll-type fluid displacement apparatus are capable of compressing, expanding, or pumping fluids.

In comparison with conventional piston-type compressors, a scroll-type compressor has a certain advantages, such as fewer parts and continuous compression of fluid. However, one problem encountered in known scroll-type compressors has been ineffective sealing of the fluid pockets. Axial sealing of the fluid pockets must be maintained in a scroll-type compressor in order to achieve efficient operation. Scroll-type fluid displacement apparatus may include a groove formed along the spiral curve and a sealing element loosely disposed in the groove, so that the end surface of the seal element seals the end plate of the other scroll. In addition, a refrigerant gas including lubricating oil, which flows into the bottom of the groove, urges the sealing elements toward the facing scroll member in order to accomplish sealing.

Known scroll-type compressors have an axial sealing mechanism including a groove formed along the spiral curve and a sealing element loosely disposed in the groove. FIG. 1 depicts two scrolls facing each other in a scroll-type refrigerant compressor in accordance with a known scroll-type compressor. Referring to FIG. 1, circular end plate 211 of orbiting scroll 21 is provided with a tubular boss 213 axially projecting from the surface opposite to the end surface from which spiral element 212 extends. Each of spiral elements 202 and 212, which is usually in contact with the other's end plate, is provided with a groove 202*a* or 212*a*, respectively, formed in its axial end surface along the spiral curve thereof and extending from the inner end portion of the spiral elements to a position close to the terminal end thereof. Sealing elements 39 and 40, which have a uniform thickness A, are fired within grooves 202*a* and 212*a*, respectively. Thus, sealing elements 39 and 40 are placed in an interfitting position with another spiral (202 and 212) element, and sealing elements 39 and 40 project from their respective spiral element by a predetermined amount.

However, axial bushing 29 is forcibly inserted into boss 213 and is rotatably supported therein by bearing, such as needle bearing 30. This forcible insertion causes tubular portion 213 to spread radially and to bend orbiting scroll 21 to have an arc-shaped cross-section due to the tolerance required between bushing 29 and tubular portion 213 to allow for the forcible insertion. Consequently, this configuration results in the creation of an air gap between the axial end surface of the spiral elements and the inner bottom portions of the scrolls, especially at the center of the scroll. Thus, the urging force caused by the refrigerant gas is insufficient to urge the sealing element toward the facing scroll member. Therefore, the discharge gas within the fluid pocket, which is defined by spiral elements of orbiting and fixed scrolls, may be permitted to leak out from the pockets. This is referred to as the "blow-by phenomenon." The "blow-by phenomenon" causes a decrease volumetric efficiency and an increase in the noise/vibration of the compressor.

SUMMARY OF THE INVENTION

It is an object of the invention to provide a scroll-type fluid displacement apparatus with high volumetric efficiency and high energy efficiency ratio.

It is another object of the invention to provide a scroll-type fluid displacement apparatus in which axial sealing of fluid pockets defined by scroll members is enhanced in the center portion of the interfitting scroll members.

According to the present invention, a scroll-type fluid displacement apparatus includes a pair of scrolls e.g., a first and a second scroll, each having an end plate and a spiral wrap extending from one side of the end pate. The spiral wraps interfit at an angular and radial offset to form a plurality of line contacts which define at least one pair of fluid pockets. A driving mechanism is operatively connected to a first scroll to orbit that scroll relative to the second scroll while preventing rotation of the second scroll to thereby change a volume of the at least one pair of fluid pockets. A sealing mechanism is disposed in at least one axial end of the spiral wraps for sealing the at least one pair of fluid pockets when defined by a central portion of the spiral wraps.

Further objects, features, and advantages of this invention will be understood from the following detailed description of the preferred embodiment of this invention referring to the annexed drawings.

DETAILED DESCRIPTION OF PREFERRED EMBODIMENTS

Figure 1:
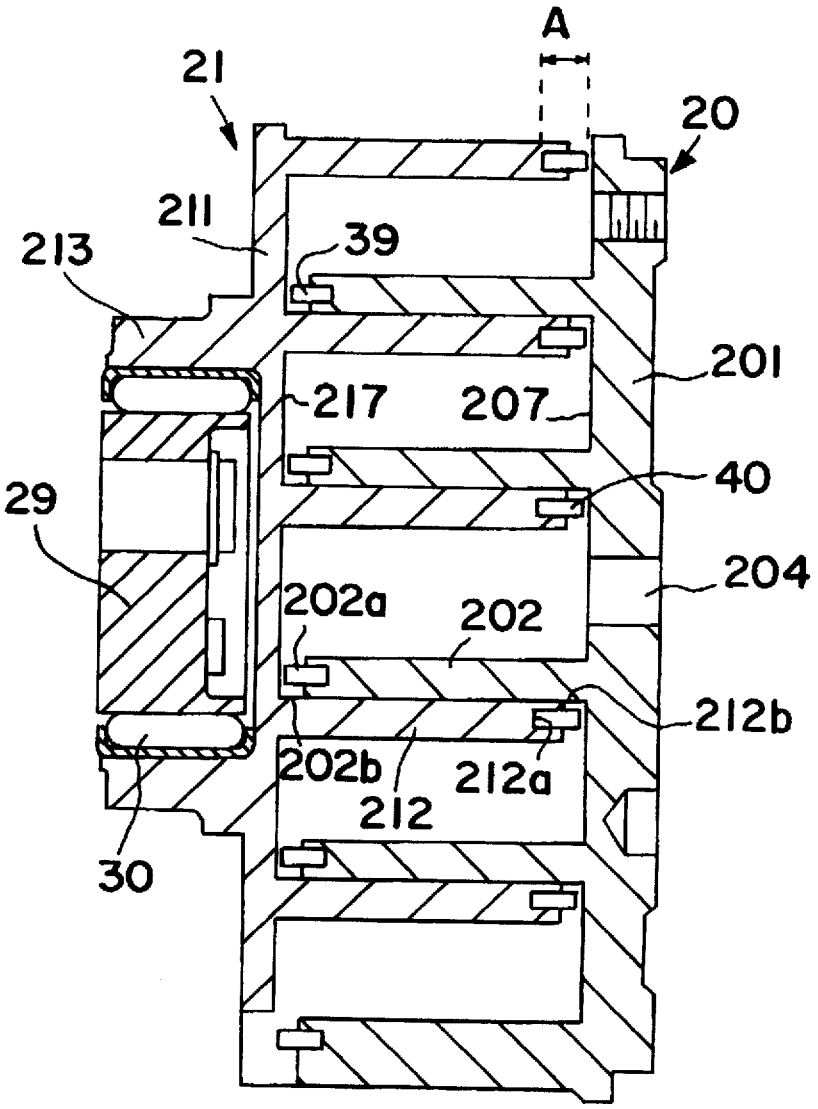
FIG. 1 PRIOR ART
FIG. 1 is an enlarged cross-sectional view of the scroll members assembled in a scroll-type compressor in accordance with the prior art.
Figure 2:
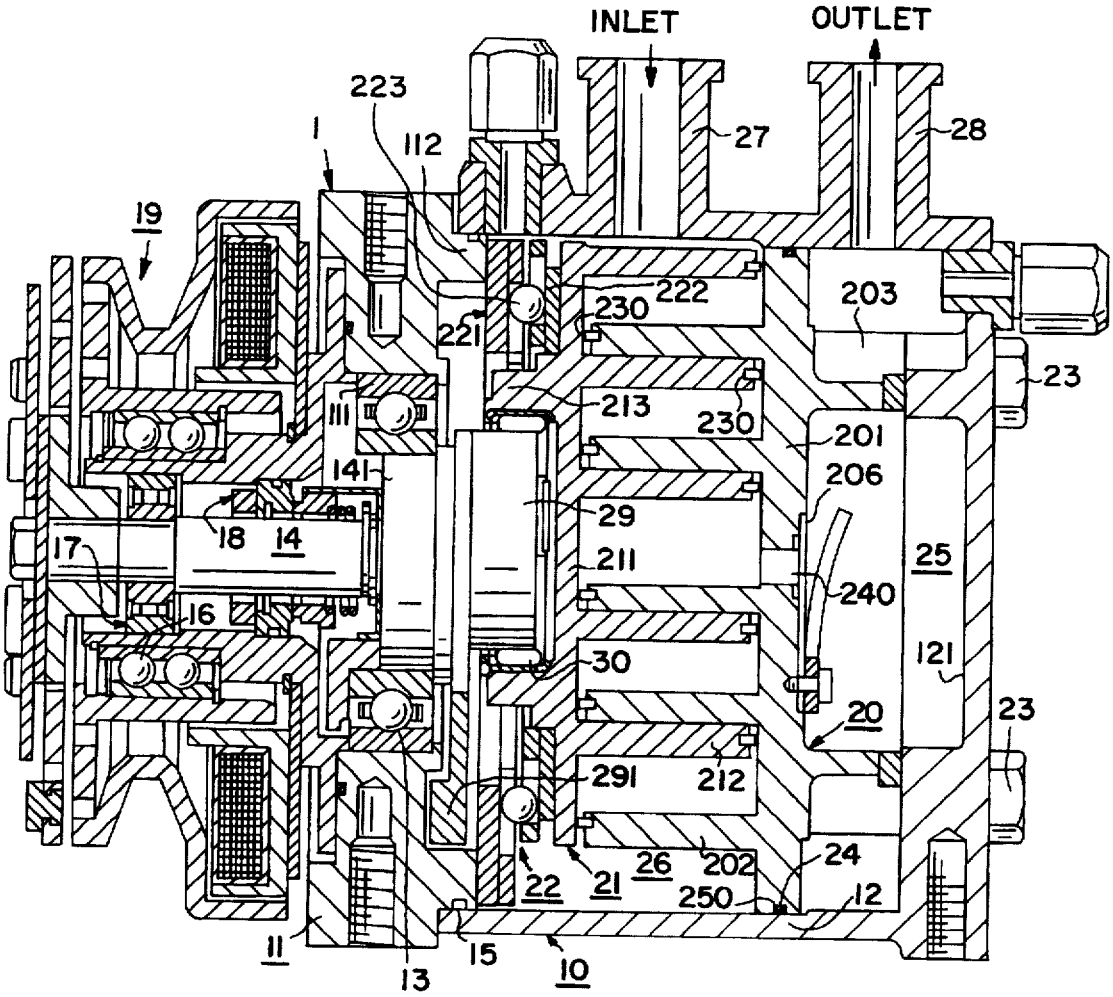
FIG. 2 is a cross-sectional view of a scroll-type compressor in accordance with a first embodiment of the present invention.

Referring to FIG. 2, a refrigerant compressor unit 1 in accordance with the present invention is shown. Unit 1 includes a compressor housing 10 comprising a front end plate 11 and a cup-shaped casing 12 attached to one side surface of front end plate 11. An opening 111 is formed in the center of front end plate 11 to permit passage of drive shaft 14. An annular projection 112, concentric with opening 111, is formed on the inside face of front end plate 11 and projects towards cup-shaped casing 12. An outer peripheral surface of annular projection 112 contacts the inner wall surface of cup-shaped casing 12. An O-ring member 15 is placed between front end plate 11 and the open portion of cup-shaped casing 12, to ensure a seal between the fitting or mating surfaces of the front end plate 11 and the open portion of cup-shaped casing 12. Cup-shaped casing 12 is fixed to front end plate 11 by fastening means, such as bolts and nuts (not shown). Thus, open portion of cup-shaped casing 12 is covered, closed, and sealed by front end plate 11.

Front end plate 11 has an annular sleeve portion 16 projecting outwardly from the front or outside surface thereof. Sleeve 16 surrounds drive shaft 14 and defines shaft cavity in the embodiment shown in FIG. 2, sleeve portion 16 is formed separately from front end plate 11. Sleeve portion 16 is fixed to the front end surface of front end plate 11 by fastening means, such as screws (not shown). Alternatively, sleeve portion 16 may be integrally formed with front end plate 11.

Drive shaft 14 is rotatably supported by sleeve portion 16 through a bearing 17 disposed within the front end portion of sleeve portion 16. Drive shaft 14 is formed with a disk rotor 141 at its inner end portion, which is rotatably supported by front end plate 11 through a beating 13 disposed within opening 111. A shaft seal assembly 18 is mounted on drive shaft 14 within a shaft seal cavity of front end plate 11.

Drive shaft 14 is coupled to an electromagnetic clutch 19 which is disposed on the outer portion of sleeve portion 16. Thus, drive shaft 14 is driven by an external drive power source, for example, the motor of a vehicle, through electromagnetic clutch 19.

A fixed scroll 20, an orbiting scroll 21, a driving mechanism for orbiting scroll 21, and a rotation preventing/thrust bearing device 22 for orbiting scroll 21 are disposed in the inner chamber of cup-shaped casing 12. The inner chamber is formed between the inner wall of cup-shaped casing 12 and front end plate 11.

Fixed scroll 20 includes a circular end plate 201 and a wrap or involute spiral element 202 fixed to and extending from one side surface of circular end plate 201. Circular end plate 201 is formed with a plurality of legs 203 axially projecting from its other side surface, as shown in FIG. 2. An axial end surface of each leg 203 is fitted against the inner surface of bottom plate portion 121 of cup-shaped casing 12 and fixed by screws 223 which engage legs 203 from the outside of bottom plate portion 121. A groove 250 is formed on the outer peripheral surface of circular end plate 201, and a seal ring member 24 is disposed therein to form a seal between the inner surface of cup-shaped casing 12 and the outer peripheral surface of circular end plate 201. Thus, the inner chamber of cup-shaped casing 12 is partitioned into two chambers by circular end plate 201: a rear or discharge chamber 25 and a front chamber 26, in which spiral elements 202 of fixed scroll 20 is disposed.

Cup-shaped casing 12 is provided with a fluid inlet port 27 and a fluid outlet port 28, which are in communication with the front and rear chamber 26 and 25, respectively. A hole or discharge port 240 is formed through circular end plate 201 at a central position of spiral element 202. Discharge port 240 places the fluid pocket formed in the center of interfitting spiral elements, e.g., the high pressure space, in communication with rear chamber 25 via a reed valve 206.

Orbiting scroll 21 is disposed in front chamber 26. Orbiting scroll 21 also comprises a circular end plate 211 and a wrap or involute spiral element 212 affixed to and extending from one side surface of circular end plate 211. Spiral element 212 and spiral element 202 interfit at an angular offset of 180° and a predetermined radial offset. A pair of fluid pockets are thereby defined between spiral elements 202 and 212. Orbiting scroll 21 is connected to the drive mechanism and to the rotation preventing/thrust bearing device 22 (both of which are described below). The proceeding two components produce the orbital motion of orbiting scroll 21 by rotation of drive shaft 14, to thereby compress fluid passing through the compressor unit according to the principles described above.

A crank pin or drive pin (not shown) projects axially inward from the end surface of disk rotor 141 and is radially offset from the center of drive shaft 14. Circular end plate 211 of orbiting scroll 21 is provided with a tubular boss 213 projecting axially outward from the end surface opposite to the side from which spiral element 212 extends. A disc-shaped or short axial bushing 29 is fitted into boss 213 and is rotatably supported therein by a bearing, such as a needle bearing 30. Bushing 29 has a balance weight 291 which is shaped as a portion of a disk or ring and extends radially from bushing 29 along a front surface thereof. An eccentrically disposed hole (not shown) is formed in bushing 29. The drive pin on disk rotor 141 is fitted into this eccentrically disposed hole. Therefore, bushing 29 is driven by the revolution of the drive pin and is permitted to rotate by needle bearing 30. Thus, the spiral element 212 of orbiting scroll 21 is urged against the spiral element 202 of fixed scroll 20 due to the net moment created between the driving point and the point at which the reaction force of the pressurized gas acts. As a result, the inner contacts are secured to effect radial sealing.

Rotation prevention/thrust bearing device 22 is disposed around boss 213 and comprises a fixed ting 221 fastened against the inner end surface of front end plate 11, an orbiting ring 222 fastened against the end surface of circular end plate 211, and a plurality of ball elements 223 retained in pairs of opposing holes which are formed through both rings 221 and 222. As a result, the rotation of orbiting scroll 21 is prevented by the interaction of balls 223 with rings 221 and 222, and the axial thrust load from orbiting scroll 21 is supported on front end plate 11 through balls 223 and fixed ting 221.

Figure 3:
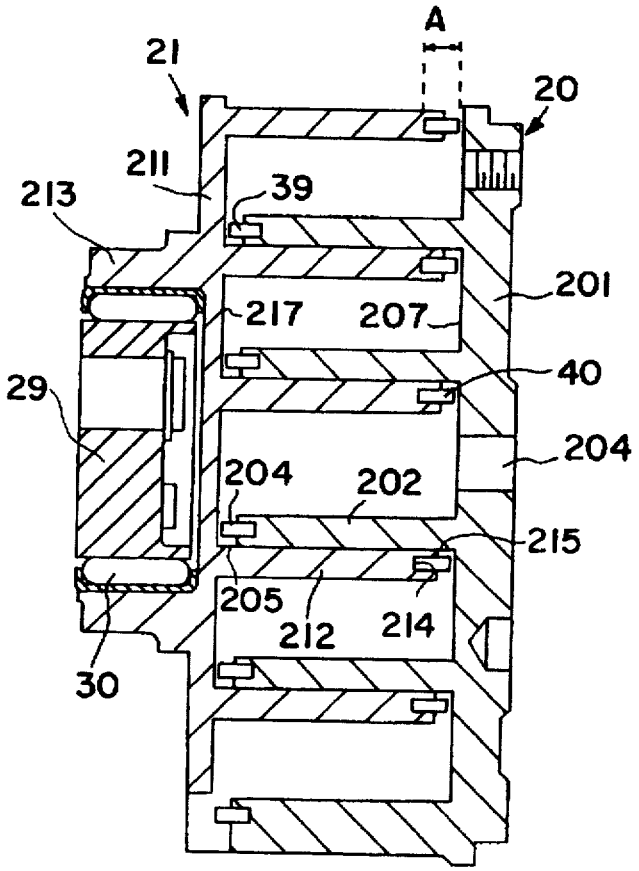
FIG. 3 is an enlarged cross-sectional view of the scroll members assembled in a scroll compressor in accordance with a first embodiment of the present invention.
Figure 4:
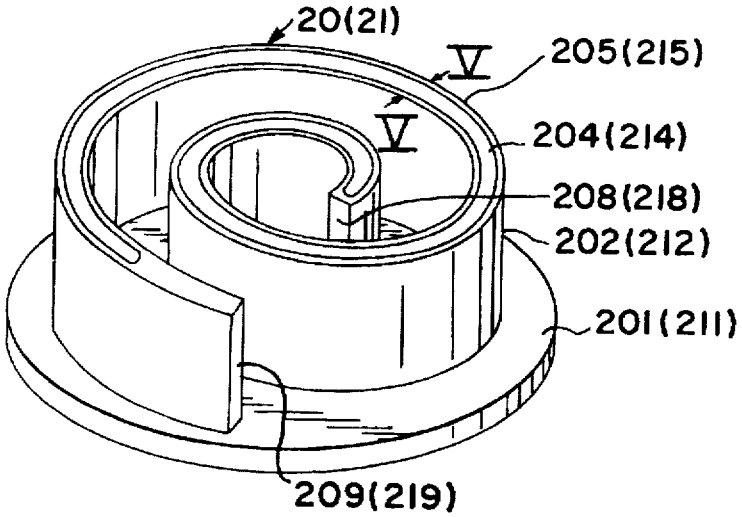
FIG. 4 is a perspective view of a scroll member in accordance with a first embodiment of the present invention.
Figure 5:
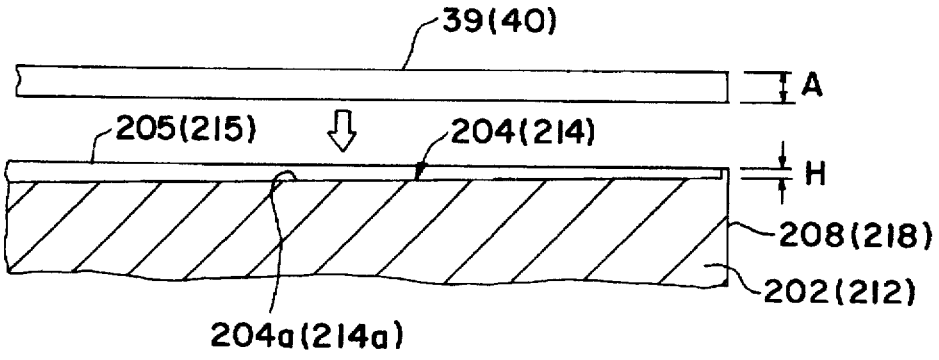
FIG. 5 is a partial cross-sectional view taken along line V—V in FIG. 4.

Referring to FIGS. 3, 4 and 5, each of spiral elements 202 and 212, which are usually in contact with the opposite end plate, is provided with a groove 204 or 214, respectively, formed in its axial end surface 205 or 215 along the spiral curve thereof and extending from inner end 208 or 218 of spiral elements 202 or 212 to a position close to terminal end 209 or 219 of spiral element 202 or 212. Sealing elements 39 and 40, which have a uniform thickness A, are fitted within grooves 204 and 214. A groove 204 and 214 includes bottom surfaces 204*a* and 214*a*, respectively, formed so as to be sloped toward axial end surface 205 and 215. A depth H of grooves 204 and 214 is designed to become gradually shallower as the groove approaches inner end 208 or 218 of spiral elements 202 and 212. Thus, sealing elements 39 and 40 have an axial dimension greater than the depth of grooves 204 and 214, respectively, so that before sealing elements 39 and 40 are placed in an interfitting position with another spiral element, sealing elements 39 and 40 project from the spiral elements by a predetermined amount. Therefore, sealing elements 39 and 40 protrude from axial end of spiral elements 202 and 212 in order to close the inner end of spiral elements 202 and 212. Therefore, the axial end portion of the inner end of sealing elements 39 and 40 sufficiently contacts the inner bottom portion 207 and 217, respectively, of fixed and orbiting scrolls 20 and 21 to avoid creation of an axial air gap.

In general, effective sealing is important to high volumetric efficiency, especially when the central high pressure space defined by the line contact between the axial end surface for the spiral element and inner bottom portions of orbiting and fixed scroll and when the two innermost fluid pockets have merged into a single pocket. When an air gap is created between the axial end surface of the spiral elements and inner bottom portions of scrolls, the discharge gas within fluid pockets defined by spiral elements of the orbiting and fixed scrolls may leak out. As mentioned above, this is called "blow-by phenomenon." Such an air gap arrangement causes "blow-by phenomenon" which results in decreased volumetric efficiency and increased noise/vibration of the compressor. However, in compressors in accordance with the invention, the axial sealing of the fluid pockets formed between the orbiting and fixed scroll may be more securely confined in all processes from the suction to the discharge state. As a result, the present invention prevents the blow-by phenomenon and increases volumetric efficiency and decrease noise and vibration of the compressor.

Figure 6:
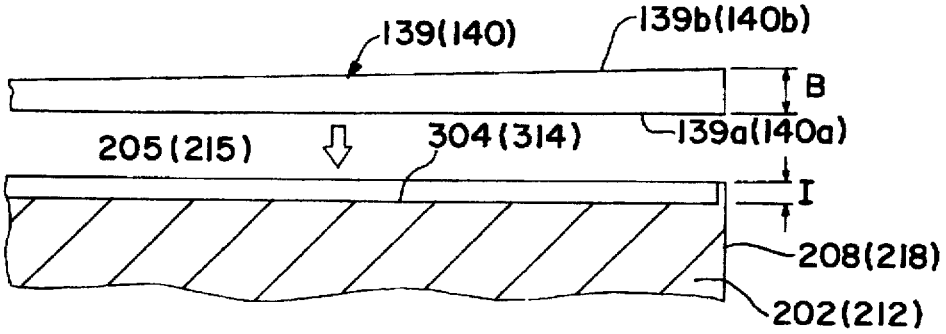
FIG. 6 is a partial cross-sectional view taken along line V—V in FIG. 4 in accordance with a second embodiment of the present invention.

FIG. 6 illustrates a second embodiment of the present invention. Elements in FIG. 6 that are similar to those in FIG. 5 are designated with the same reference numerals.

Each of spiral elements 202 and 212, which are usually in contact with each other's opposite end plate, is provided with a groove 304 or 314, respectively, formed in its axial end surface 205 or 215 along the spiral curve thereof and extending from inner end 208 or 218 of spiral elements 202 or 212 to a position close to terminal end 209 or 219 of spiral elements 202 and 212. Grooves 304 and 314 have a uniform depth I. Sealing elements 139 and 140 include bottom surfaces 139*a* and 140*a* and upper surfaces 139*b* and 140*b* which are formed to be sloped toward bottom surfaces 139*a* and 140*a*. Sealing element 139 and 140 have thickness B and are designed to gradually increase in thickness toward one end portion thereof. Moreover, they are fitted within grooves 304 and 314, respectively, so that the end portion having the greater thickness is disposed in the side of inner end 208 and 218. Consequently, the axial ends of sealing elements 139 and 140 protrudes more from axial ends 205 and 215 of spiral elements 202 and 212 than from inner end 208 and 218 of spiral element 202 and 212.

Figure 7:
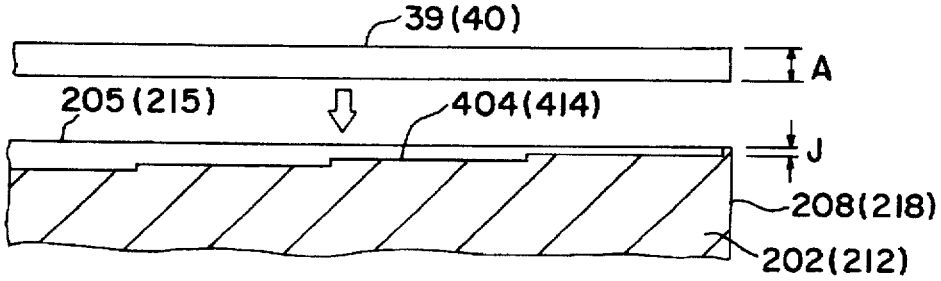
FIG. 7 is a partial cross-sectional view taken along line V—V in FIG. 4 in accordance with a third embodiment of the present invention.

FIG. 7 illustrates a third embodiment of the present invention. Elements in FIG. 7 that are similar to those in FIG. 5 are designated with the same reference numerals.

Each of spiral elements 202 and 212 is provided with a groove 404 or 414, respectively, formed in its axial end surface 205 and 215 along the spiral curve thereof and extending from the end portion of the spiral elements to a position at about the terminal end thereof. Sealing elements 39 and 40, which have a uniform thickness A, are fitted within grooves 404 and 414, respectively. A depth J of the inner bottoms of grooves 237 and 238 is reduced from the terminal end in step-like fashion. Grooves 404 and 414 also may include a plurality of steps at regular intervals or may include at least one step formed therein.

Figure 8:
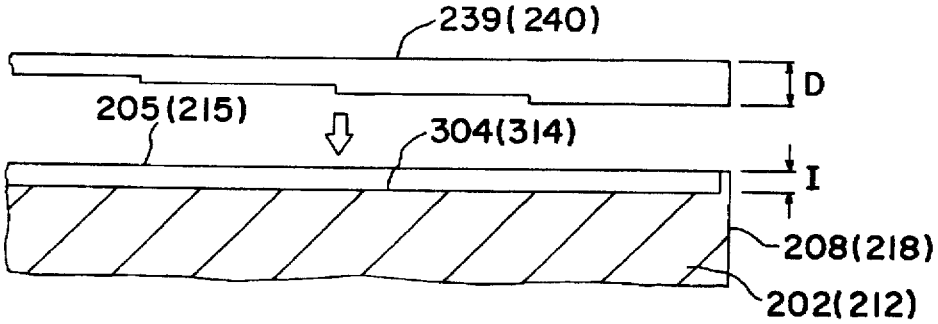
FIG. 8 is a partial cross-sectional view taken along line V—V in FIG. 4 in accordance with a fourth embodiment of the present invention.

FIG. 8 illustrates a second embodiment of the present invention elements in FIG. 8 that are similar to those in FIG. 5 are designated with the same reference numerals.

Each of spiral elements 202 and 212 is provided with a groove 304 or 314, respectively, formed in its axial end surface 205 or 215 along the spiral curve thereof and extending from the inner end portion of the spiral elements to a position close to the terminal end thereof. Grooves 304 and 314 have a uniform depth I. Sealing elements 239 and 240 have a thickness D which decreases from the terminal end in step-like fashion. Sealing elements 239 and 240 may include a plurality of steps at regular intervals or may include at least one step therein. Sealing elements 239 and 240 are fitted within groove 304 and 314, respectively, so that the end portion having the greater thickness is disposed in the side of inner end 208 and 218. Consequently, the axial ends of sealing elements 239 and 240 protrude more from axial end 205 and 215 of spiral elements 202 or 212 than inner end 208 or 218 of spiral element 202 or 212. Further, sealing elements 239 and 240 may be inserted into groove 304 or 314 upside down with respect to the embodiment depicted in FIG. 8.

Substantially the same advantages as those achieved in the first embodiment are realized in the second, third, and fourth embodiments.

Although the present invention has been described in connection with preferred embodiments, the invention is not limited thereto. It will be understood by those of ordinary skill in the art that variations and modifications may be readily made within the scope of this invention as defined by the appended claims.

What is claimed is:

1. A scroll-type fluid displacement apparatus comprising:

a pair of scrolls each having an end plate and a spiral wrap extending from a side of said end plate, said spiral wraps interfitting at an angular and radial offset to form a plurality of line contacts which define at least one pair of fluid pockets;

a driving mechanism operatively connected to a first scroll of said scrolls to orbit said first scroll relative to a second scroll of said scrolls, while preventing rotation of said second scroll, to thereby change a volume of said at least one pair of fluid pockets; and sealing means disposed in at least one axial end of said spiral wraps for sealing said at least one pair of fluid pocket when defined by a central portion of said spiral wraps, said sealing means including a protruding portion protruding from said at least one axial end of said spiral wraps, wherein a height of said protruding portion increases towards a radial inner end of said spiral wraps.

2. The scroll-type fluid displacement apparatus of claim 1, wherein said sealing means includes a groove formed in an axial end surface of said spiral wrap along a spiral curve and a sealing element disposed within said groove, such that an axial end of said sealing element extends above an axial end of said wrap at a radial inner end of said wrap.

3. The scroll-type fluid displacement apparatus of claim 2, wherein said groove includes at least one step therein, such that a depth of said groove is reduced at a radial inner end of said spiral wrap.

4. The scroll-type fluid displacement apparatus of claim 2, wherein said groove has a plurality of steps reducing a depth of said groove as said groove approaches a radial inner end of said spiral wrap.

5. The scroll-type fluid displacement apparatus of claim 2, wherein a thickness of said sealing element increases as said groove approaches a radial inner end of said spiral wrap.

6. The scroll-type fluid displacement apparatus of claim 2, wherein said sealing element includes at least one step portion, such that a thickness of said sealing element increases at a radial inner end of said spiral wrap.

* * * * *